US010495383B2

(12) United States Patent
Naukkarinen

(10) Patent No.: US 10,495,383 B2
(45) Date of Patent: Dec. 3, 2019

(54) WOUND LAYERED TUBE HEAT EXCHANGER

(75) Inventor: Olli Pekka Naukkarinen, Memphis, TN (US)

(73) Assignee: MODINE GRENADA LLC, Grenada, MS (US)

( * ) Notice: Subject to any disclaimer, the term of this patent is extended or adjusted under 35 U.S.C. 154(b) by 154 days.

(21) Appl. No.: 12/715,072

(22) Filed: Mar. 1, 2010

(65) Prior Publication Data

US 2011/0209857 A1 Sep. 1, 2011
US 2013/0098586 A9 Apr. 25, 2013

Related U.S. Application Data

(63) Continuation of application No. 10/993,708, filed on Nov. 19, 2004, now abandoned.

(51) Int. Cl.
*F28D 7/02* (2006.01)
*F28F 9/013* (2006.01)

(52) U.S. Cl.
CPC ..... *F28D 7/02* (2013.01); *F28F 9/0132* (2013.01); *F28F 2240/00* (2013.01); *Y10T 29/49391* (2015.01)

(58) Field of Classification Search
CPC ..... F28D 7/02; F28F 2240/00; F28F 9/0132
USPC ..... 165/150, 151, 163
See application file for complete search history.

(56) References Cited

U.S. PATENT DOCUMENTS

| | | | | | |
|---|---|---|---|---|---|
| 2,056,862 | A * | 10/1936 | Markley, Jr. | A01J 9/04 | 165/172 |
| 3,080,916 | A * | 3/1963 | Collins | F28F 1/32 | 165/150 |
| 3,292,689 | A * | 12/1966 | Keiichi | F28F 1/32 | 165/151 |
| 3,433,300 | A * | 3/1969 | Pasternak | F28F 1/32 | 165/151 |
| 4,175,617 | A * | 11/1979 | Hahn | F25D 17/062 | 165/163 |
| 4,484,624 | A * | 11/1984 | Vleggaar et al. | 165/163 | |
| 4,605,059 | A * | 8/1986 | Page | 165/163 | |
| 4,778,004 | A * | 10/1988 | Paulman et al. | 165/150 | |
| 2007/0125528 | A1 * | 6/2007 | Fakheri | F28F 1/32 | 165/163 |

* cited by examiner

*Primary Examiner* — Leonard R Leo
(74) *Attorney, Agent, or Firm* — Michael Best & Friedrich LLP; Jeroen Valensa; Michael Bergnach

(57) ABSTRACT

A wound tube heat exchanger 10 article that receives a heat exchange fluid and its method of manufacture. The exchanger 10 has one or more layers 12 of a tube 14. In one embodiment, the tube surface is bare. In other embodiments, the outside tube surface is enhanced to produce turbulence. At least some of the layers 12 have an ovate oblong configuration. A pair of opposing linear runs 16,18 is connected by a pair of opposing curved sections 20,22. In some embodiments, the layers are circular, oval or rectangular with radiused corners. An elongate spacer member 24 has forwardly 26 and rearwardly 28 facing edges. Defined within those edges are engagement surfaces 30 that detachably retain the opposing linear runs 16,18.

22 Claims, 7 Drawing Sheets

(a) (b)

WOUND LAYERED TUBE HEAT EXCHANGER

CROSS-REFERENCE TO RELATED APPLICATIONS

The present application is a continuation of U.S. application Ser. No. 10/993,708, filed on Nov. 19, 2004, now abandoned.

BACKGROUND OF THE INVENTION

1. Field of the Invention

This invention relates generally to tube configurations used in heat exchangers and their methods of manufacture.

2. Background Art

In many chemical, electronic, and mechanical systems, thermal energy is transferred from one location to another or from one fluid to another. Heat exchangers allow the transfer of heat from one fluid (liquid or gas) to another fluid. Conventionally, the reasons for transferring heat energy are:

(1) to heat a cooler fluid using a warmer fluid;

(2) to reduce the temperature of a hot fluid by using a cooler fluid;

(3) to boil a liquid using a hotter fluid;

(4) to condense a gas by a cooler fluid; or (5) to boil a liquid while condensing a hotter fluid in the gaseous state.

Regardless of the function the heat exchanger fulfills, in order to transfer heat, the fluids in thermal contact must be at different temperatures to allow heat to flow from the warmer to the cooler fluid according to the second principle of thermodynamics.

Traditionally, for round tube plate fin heat exchangers there is no direct contact between the two fluids. Heat is transferred from the fluid to the material isolating the two fluids and then to the cooler fluid.

Some of the more common applications of heat exchangers are found in the heating, ventilation, air conditioning and refrigeration (HVACR) systems, electronic equipment, radiators on internal combustion engines, boilers, condensers, and as pre-heaters or coolers in fluid systems.

All air conditioning systems contain at least two heat exchangers—usually an evaporator and a condenser. In each case, the refrigerant flows into the heat exchanger and transfers heat, either gaining or releasing it to the cooling medium. Commonly, the cooling medium is air or water.

A condenser accomplishes this by condensing the refrigerant vapor into a liquid, transferring its phase change (latent) heat to either air or water. In the evaporator, the liquid refrigerant flows into the heat exchanger. Heat flow is reversed as refrigerant evaporates into a vapor and extracts heat required for this phase change from the hotter fluid flowing on the outside of the tubes.

Tubular heat exchangers include those used in an automotive heat exchanger environment, such as a radiator, a heater coil, an air cooler, an intercooler, an evaporator and a condenser for an air-conditioner. For example, a hot fluid flows internally through pipes or tubes while a cooler fluid (such as air) flows over the external surface of the tubes. Thermal energy from the hot internal fluid transfers by conduction to the external surface of the tubes. This energy is then transferred to and absorbed by the external fluid as it flows around the tubes' outer surfaces, thus cooling the internal fluid. In this example, the external surfaces of the tubes act as a surface across which thermal energy is transferred.

Traditionally, longitudinal or radial fins may be positioned in relation to the external surface of the tubes to turbulate the externally flowing fluid, increase the area of the heat transfer surface and thus enhance the heat transfer capacity. One disadvantage, however, is that fins add to material and manufacturing cost, bulk, handling, servicing and overall complexity. Further, they occupy space and therefore reduce the number of tubes that can fit within a given cross sectional area and they collect dust and dirt and may get clogged, thereby diminishing their effectiveness.

Densely configured external fins tend to constrict external fluid flow. This promotes an increase in the pressure drop of the external fluid across the heat transfer surface and may add to heat exchanger costs by requiring more pumping power. In general, expense related to pumping is a function of the pressure drop.

Fin-less, tube heat exchangers are known. See, e.g., U.S. Pat. No. 5,472,047 (Col. 3, lines 12-24). Conventionally, however, they are made of tubes having a relatively large outside diameter. Often, tubes are joined with wires, such as the steel coils found at the back of many residential refrigerators.

The U.S. references identified during a pre-filing investigation were: US 2004/0050540 A1; US 2004/0028940 A1; U.S. Pat. Nos. 5,472,047; 3,326,282; 3,249,154; 3,144,081; 3,111,168; 2,998,228; 2,828,723; 2,749,600; and 1,942,676.

Foreign references identified during a pre-filing investigation were: GB 607,717; GB 644,651; and GB 656,519.

SUMMARY OF THE INVENTION

The invention includes a wound tube heat exchanger, which receives a heat exchange fluid that flows within the exchanger. The exchanger has one or more layers of a one or more small diameter (preferably with an OD<5 mm), tubes. In one embodiment, the tube surface is bare. In other embodiments, the outside tube surface is enhanced to produce turbulence and convective heat transfer. Each layer is wound around and is separated by a spacer members. At least some of the layers have an ovate, oblong or racetrack-like configuration with a pair of opposing linear runs that are connected by a pair of opposing curved sections. The elongate spacer member has forwardly and rearwardly facing edges. The edges define engagement surfaces that detachably retain the opposing linear runs. In some embodiments, the layers are circular, oval or rectangular with radiused corners. Spacer members may act as support members, fixtures and/or thermal communication devices between tubes and may become part of the refrigerant circuit. Furthermore, the spacer member may promote condensate drainage from evaporative heat exchangers.

BRIEF DESCRIPTION OF THE DRAWINGS

FIG. 7(*b*) is a cross sectional view of the heat exchanger depicted in FIGS. 2, 5 & 7(*a*).

DETAILED DESCRIPTION OF THE PREFERRED EMBODIMENT(S)

Figure 1:
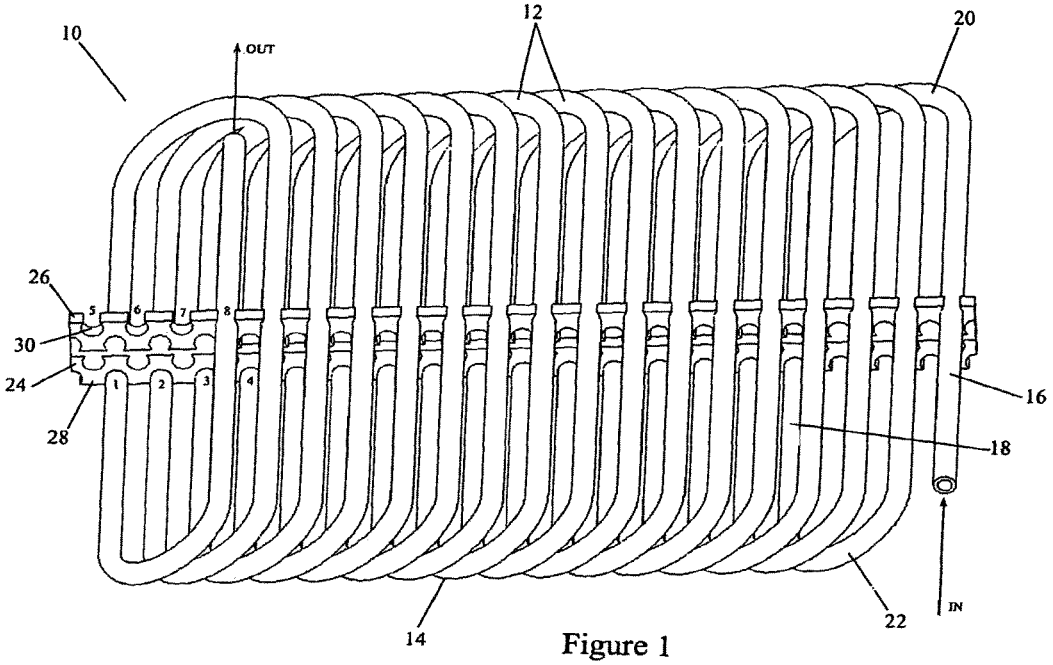
FIG. 1 is a side elevation view of a wound layered tube heat exchanger according to the present invention.
Figure 3:
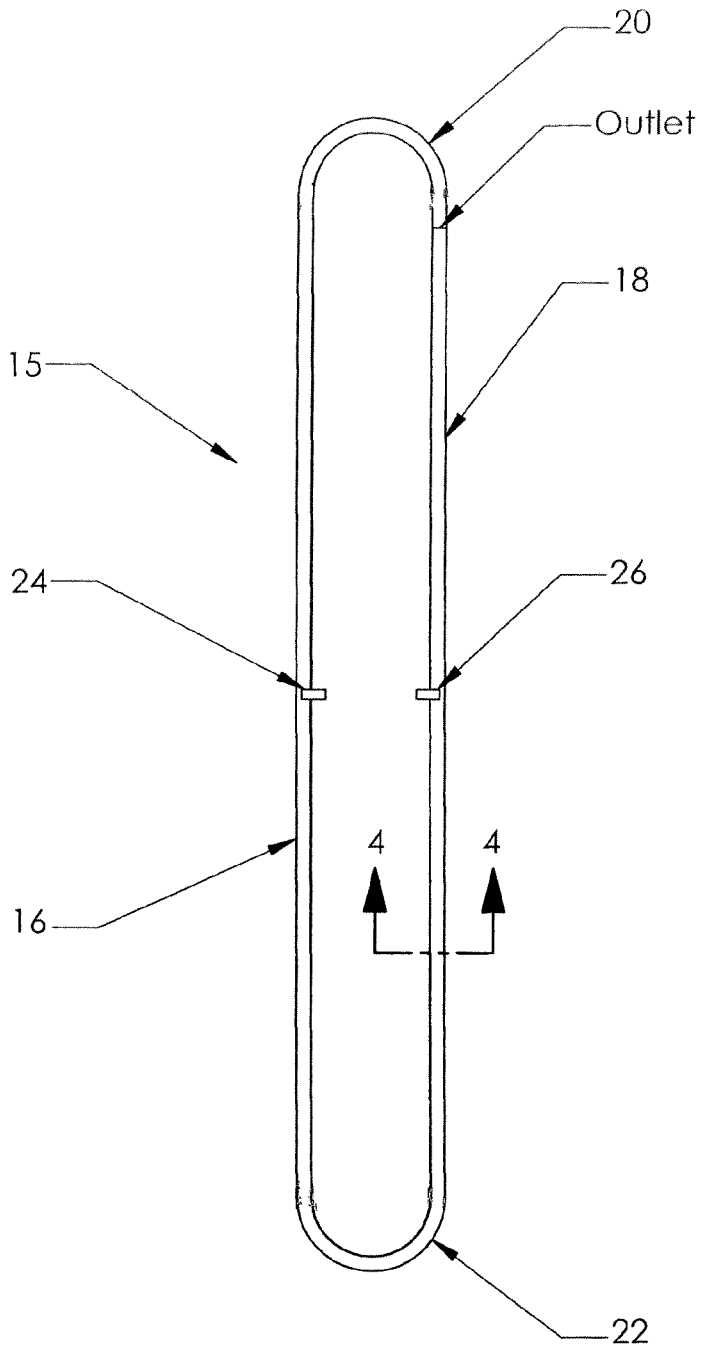
FIG. 3 is an end view of one revolution of one winding of the tube heat exchanger.
Figure 4:
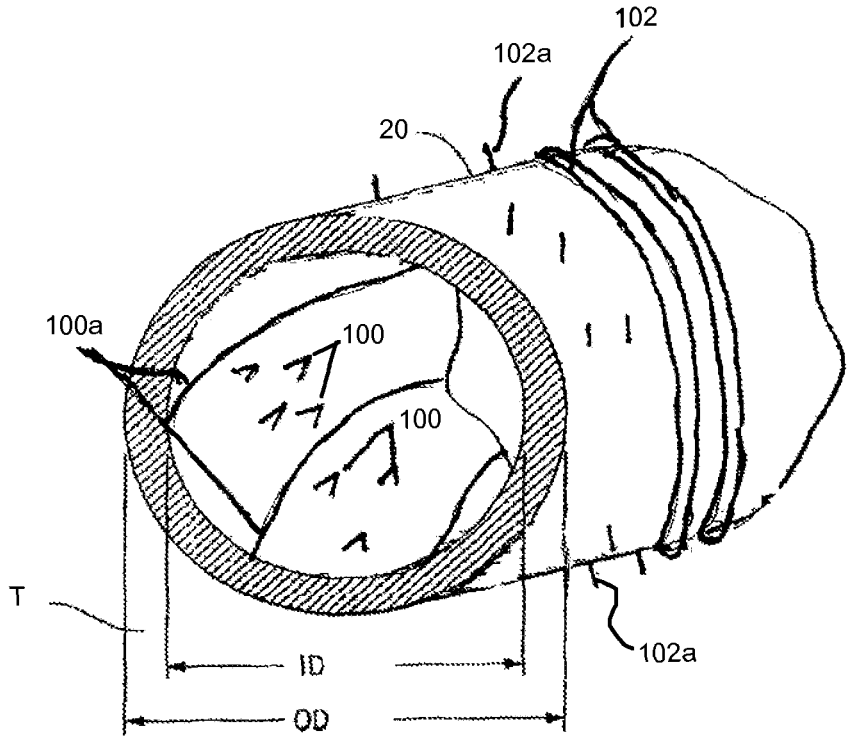
FIG. 4 is a cross section taken along the line 4-4 of FIG. 3 of a small diameter tube heat exchanger of the present invention.

FIGS. 1 & 3-4 depict a tube heat exchanger 10 for receiving a heat exchange fluid that flows within the heat exchanger. In one embodiment the tube surface is bare. In other embodiments, the outside tube surface is enhanced to disturb air flow and promote convective heat transfer. The heat exchanger has one or more layers 12 of a single, long, continuous, tube 14. The tube 14 has an outside diameter (OD), an inside diameter (ID) along which the heat exchange fluid passes, and a wall thickness (T=(OD−ID)/2)). It will be appreciated that the tube 14 need not be circular or annular in cross section. For some applications, for example, the tube 14 may usefully have an oval configuration or other non-circular cross section which may be helpful in directing incident air flow and promoting local turbulence.

At least some of the one or more layers 12 have an ovate, oblong, or racetrack-like configuration 15 (FIG. 3). Each revolution includes a pair of opposing linear runs 16,18 that are connected by a pair of opposed curved sections 20,22. It will be appreciated that the radius of the opposed curved sections 20,22 within a given configuration 15 need not be equal. In some embodiments, the layers are circular, oval or rectangular with radiused corners.

As shown in FIG. 1, an elongate spacer member 24 defines engagement surfaces 30 that detachably retain the opposing linear runs. The engagement surfaces 30 are defined within the forwardly 26 and rearwardly 28 facing edges. The forwardly facing edge 26 detachably retains one linear run 16 of one revolution 32 of the racetrack-like configuration 15. The rearwardly facing edge 28 detachably retains the other linear run 18 of the one revolution of the racetrack-like configuration.

Although in FIG. 1 only one spacer member 24 is depicted, it will be appreciated that additional spacer members 24 may be provided within the same heat exchanger. The spacer members 24 may or may not be parallel with each other and may or may not extend perpendicularly in relation to the linear runs 16 in those embodiments of the heat exchanger wherein the tubes assume a racetrack-like configuration 15.

Figure 2:
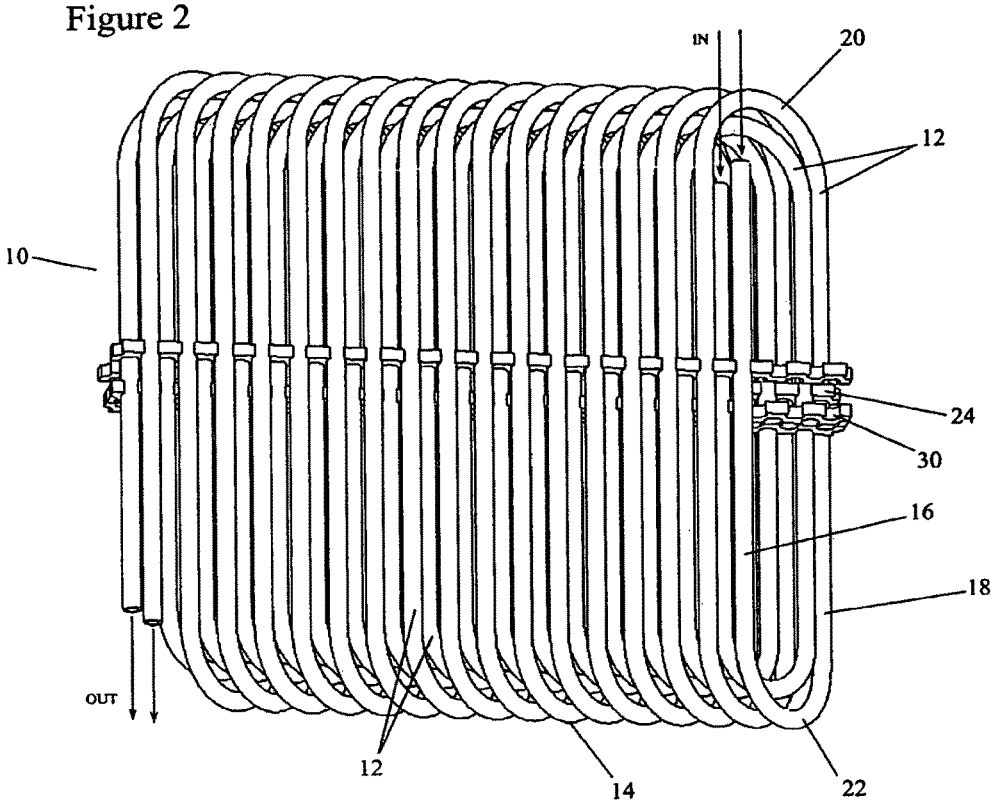
FIG. 2 is a quartering perspective view of a multiple layer wound tube heat exchanger according to the present invention.

FIGS. 1-2 depict bundles of coiled tubing that serve as a heat exchanger. Noteworthy in the embodiment depicted is the absence of fins or louvers (with the exception of spacer members) that are often used in heat exchangers to promote air flow and thus the efficiency of thermal energy transfer. If desired, however, as mentioned earlier, the outside diameter of the tubes can be enhanced in order to promote turbulent flow. Such enhancements may include an annular collar that may extend perpendicularly or obliquely from the tube's outside surface.

In FIG. 1, a heat exchanger fluid enters a small diameter coiled tube at the inlet. In several applications, the incoming fluid is a refrigerant or another liquid such as water that is suitable for heat transfer. In some cases, the water could be introduced at a relatively high temperature. In such applications, the heat exchanger serves to elevate the temperature of a fluid such as air that passes around and outside the coiled tubes.

The invention includes a continuous tube having several windings. In practice, the windings are prepared by conforming the tubes' outside diameter with a tool such as a mandrel that typically is relatively flat and long. Conventional working operations produce a series of tube windings that are composed of layers of coiled sections that are generally ovate, oblong, oval or racetrack-like in shape. A rounded corner lies at each end of the oval configuration. The rounded corners are connected at opposite ends of each oval by linear, relatively straight runs.

In one manufacturing process, the mandrel has an outside surface in which one or more continuous helical grooves are defined. During the winding steps, the tube becomes accommodated by the helical groove.

By using rounded corners, kinks and sharp changes in bend radii are avoided. In general, the bend radius (R) is large (about 10:3) in relation to the outside diameter (OD) of the tube.

The spacer member 24 serves to position interposed tube layers. Detents, preferably frusto-circular if round tubes are used, 30 are defined within edges 26,28 of the spacer. These detents 30 terminate at the spacer edges in a position that is slightly offset from a major diameter of a detent, which may be circular, or noon-circular. In this way, the outside diameter of a linear tube run is engaged by a snap fit within the spacer. The distance between consecutive detents (center-to-center of the grooves) influences the heat transfer properties of the heat exchanger. In one embodiment, this distance is twice the outside diameter (OD) of the tube.

When successive layers of the coil are engaged by the spacer 24, their overall orientation is relatively flat, as shown in FIGS. 1-2.

One consequence of a staggered (as opposed to an in-line) configuration as shown is that there are relatively few spaces through which fluid flowing outside the tubes and through the heat exchanger can pass without interruption. Because of the relatively tight packing density of the tube configuration depicted, fluid flowing around the outside of the tubes is in thermal contact for a protracted period ("dwell time") with the tube runs 16,18 that are positioned above and below the spacer 24.

No headers are needed at the inlet or the outlet side of the heat exchanger. Nor are there any serpentine fins or louvers. Accordingly, in a preferred embodiment, the heat exchanger effectively is a wound layered tube apparatus. Hence, it is less expensive to manufacture and maintain than conventional round tube plate fin heat exchangers.

The spacing member 24 serves to position adjacent tubes in a given layer and to separate the layers within a given coil (FIG. 2). Preferably, the spacer member 24 (FIG. 1) is formed from a deformable material primarily to accommodate a snap fitting engagement with the tube runs 16,18. If desired, the spacing member 24 may be formed from a heat conducting material. If so, heat may be transferred efficiently between tube surfaces and a heat exchange fluid that moves outside tube surfaces that are in thermal communication with each other.

FIG. 2 depicts an alternate embodiment heat exchanger in which there are multiple layers. In practice, the innermost coil is first formed on a spacer member 24. The outer layer is then wound around on top of it. Positioning of adjacent coils in a given layer and between the layers themselves is enabled by a selection of suitable spacer geometry. It should be appreciated that if desired, the tube diameter in an innermost layer may differ from that found in an outermost layer. In such embodiments, it is preferable that the outside diameter of the outermost tube layers exceed that found in the innermost tube layers.

Where the heat exchanger serves as an evaporator, a liquid refrigerant flows into the inlet. Following heat transfer, its temperature rises so that it vaporizes inside the tube. This lowers the temperature of the tube, which in turn lowers the temperature of a fluid such as air that is in thermal contact with the outside of the tube. In practice, it is sometimes desirable to adjust the flow of the incoming liquid refrigerant so as to produce 100% of vapor at the outlet that is not superheated; i.e., it exits at around its boiling temperature.

Conventionally, a control system is adapted in order to accomplish this thermodynamic state. In practice, the vaporized refrigerant will enter a compressor, which will increase the pressure of the vaporized refrigerant. Its temperature then rises, just as the temperature of the barrel of a bicycle pump rises when a bicycle tire is inflated. Pressurized vaporized refrigerant then enters a condenser, which may be formed from a wound layered tube, such as the embodiments described herein. The condenser effectively changes the state of the compressed and warmed refrigerant fluid so that it becomes preferably completely-liquified to a lower temperature. In turn, the refrigerant fluid in that state is delivered to an evaporator, which again can be formed from a wound layered tube heat exchanger such as the embodiments depicted.

The heat exchanger tubes can be made from any heat-conducting material. Metals, such as copper or aluminum are preferred, but plastic tubes having a relatively high thermal conductivity may also be used.

The practical relationships between the tube inside diameter (ID), outside diameter (OD), and wall thickness (T) are somewhat limited by the manufacturing techniques used to form the tube. Clearly, the selection of suitable dimensions will influence the pressure-bearing capability of the resulting heat exchanger. In general, it can be stated that as the outside diameter (OD) decreases, the thinner the wall section (T) can be. Preferably, the outside diameter (OD), inside diameter (ID) and thus wall thickness (T) should be selected so that the tube can hold the pressure of a refrigerant without deformation of the tube material. When the outside diameter decreases, there is more tube outer surface as compared to the internal volume of the tube. As a consequence, there is more heat transfer area per refrigerant volume.

Environmentally benign consequences of using carbon dioxide as a refrigerant fluid often occur. Operating pressures are higher than normal refrigerants. Small diameter tube heat exchangers are beneficial when using carbon dioxide as a refrigerant as carbon dioxide has low viscosity and thus the pressure drop within a tube is small. In addition, the tube wall can be kept thin in spite of high operating pressures. If there is any leakage, the consequences to ambient atmosphere do not present significant environmental risks.

As is apparent from the drawings, the spacer member 24 prevents tube migration. Preferably, the spacing of grooves 30 within the spacer member 24 is such as to cause the runs of consecutive layers to lie closely together and in parallel. This results in a packing density that presents a resistance to the passage of ambient heat exchange fluid, induces local turbulence, diminishes laminar flow, and thereby promotes the efficiency of heat transfer.

One drawback of conventional evaporators is that water condensate tends to accumulate at various locations within the heat exchanger. This tends to block the air flow. By positioning the invention in a vertical orientation (FIG. 1), however, this problem is avoided because any condensate flows downwardly under gravity and away from the central portion of the heat exchanger. This process may be facilitated through spacer members.

An additional attribute of the spacer member 24 is that it supports the three-dimensional shape of the tube heat exchanger. Although one spacer member 24 is depicted in FIGS. 1-2, it will be appreciated that other spacer members could additionally be deployed within a given heat exchanger. Additional spacer members 24 could for example, serve to deflect air flow advantageously so that the predominant air flow occurs through the central regions of the heat exchanger where the linear coil segments run in close parallel proximity.

If desired, the embodiments of FIGS. 1 and 2 could be connected in series or parallel. Parallel configurations could be helpful when more capacity is needed. Such configurations may be advantageous where a long tube length may cause too high of a pressure drop and thus refrigerant flow is limited. In such arrangements it may be useful to use manifolds to provide the refrigerant flow to inlets and outlets downstream of the primary outlet.

Figure 5:
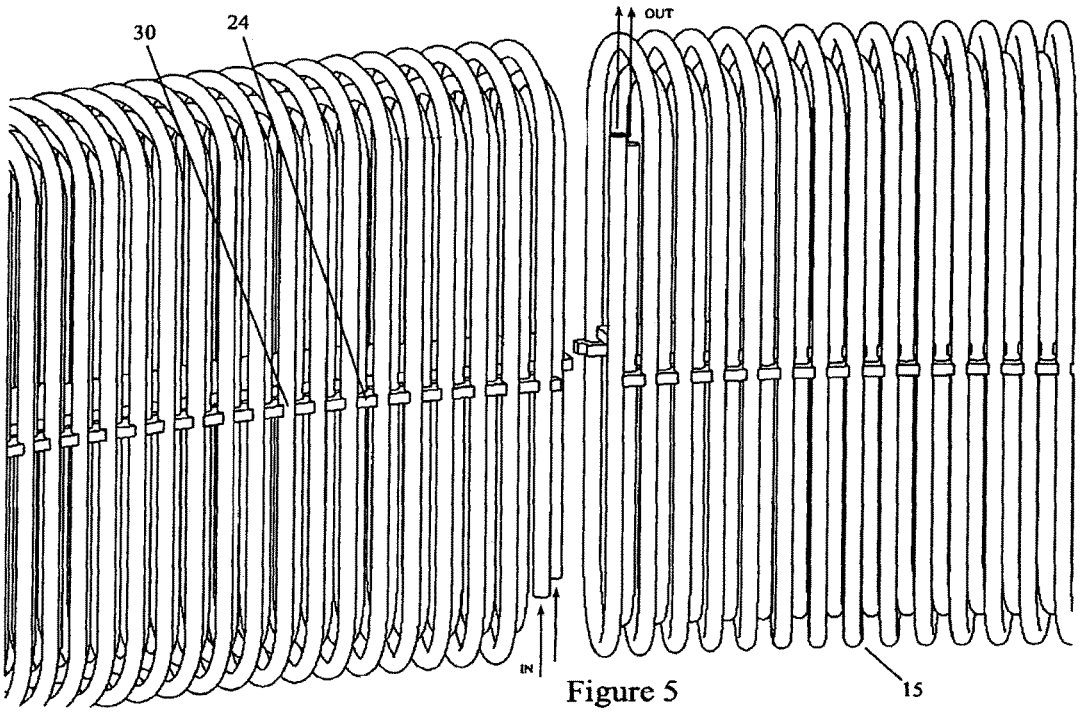
FIG. 5 is an embodiment of a 2-layer heat exchanger wherein the embodiment of FIG. 1 is lengthened and the spacer member assumes a circular or hoop-like configuration.

FIG. 5 depicts an embodiment of heat exchanger 10 wherein embodiment of FIG. 1 is lengthened and the spacer member 24 assumes a toroidal or hoop-like configuration. In such a case, the overall orientation of the wound layered tube heat exchanger can assume, rounded, annular aspect.

The embodiment depicts two layers on both sides. Typically, this configuration is suitable for such application as an air conditioning heat exchange unit's condenser. In such applications, ambient air flows radially under the influence of a fan that may be located on the top or bottom of the heat exchanger. Conditioned air thereafter flows outwardly axially.

Figure 6:
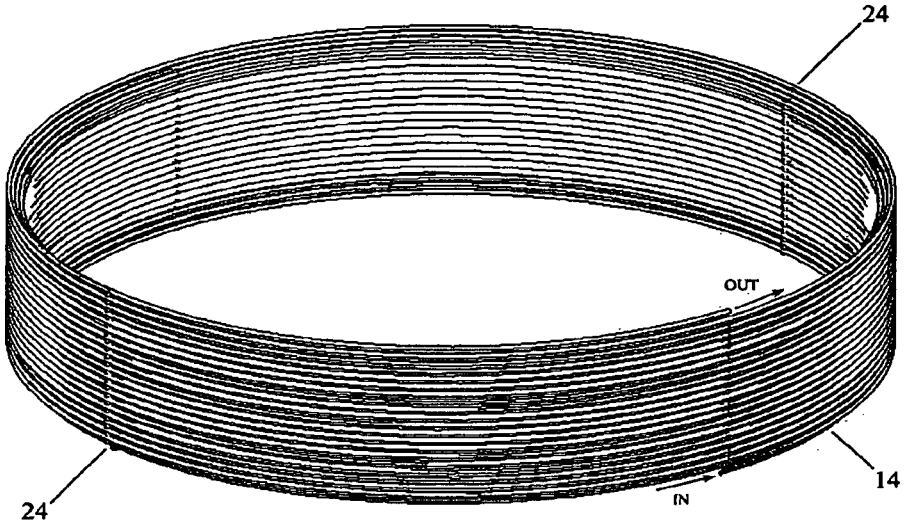
FIG. 6 is a quartering perspective view of an alternate embodiment of the disclosed heat exchanger.

FIG. 6 depicts an embodiment of the invention wherein there are two spacer members 24. These members position a rounded coil of successive terms formed by the length of tube 14. In that embodiment, the heat exchange fluid that moves inside the tube flows axially upwardly or downwardly and then radially outwardly from one layer to another.

If desired, any of the tubes depicted in FIGS. 1-6 may have an enhanced internal surface, such as internally positioned grooves—like those that may be defined within the barrel of a rifle for spinning the bullet before as it passes along the bore. Similarly, the provision of internally oriented grooves serves to spin the heat exchange fluid as it flows within the tube. This tends to promote efficiency of heat transfer by disturbing laminar flow within the tube. Additionally, the positioning of such surface enhancements tends beneficially to disturb co-existing phases (e.g. vapor/liquid) within the tube.

Where the tube is seamless, the surface enhancements are generally axial. Where the tube is welded, internal enhancements may be axial, helical, or a combination thereof. It will be appreciated that the geometry of the internal enhancements can include incursions that are cross-hatched, disposed in a herringbone or V configuration 100, or otherwise in the form of a turbo-spiral surface texture 100*a*. Internal surface enhancements of the type shown in FIG. 4 are well known to those having ordinary skill in the art.

Figure 7:
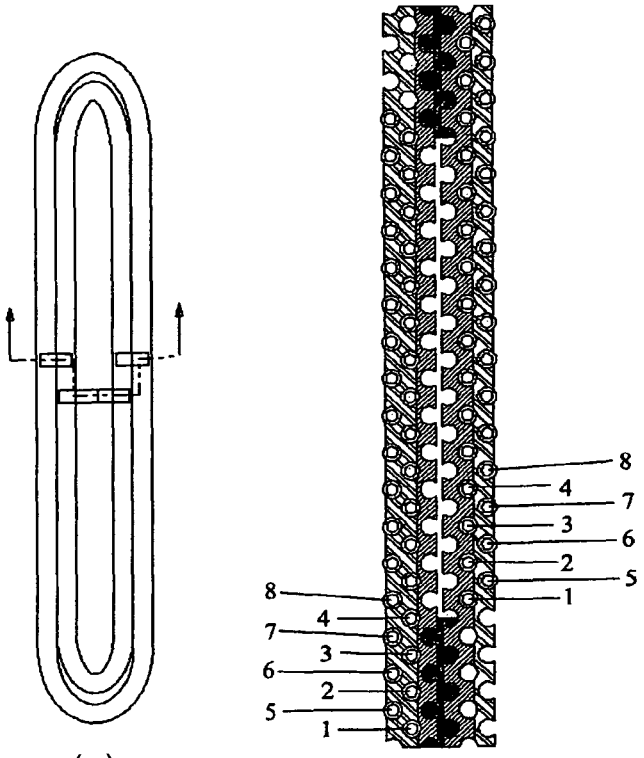
FIG. 7(*a*) is an end view of the 2-layer heat exchanger depicted in FIG. 2 & FIG. 7(*b*)

Referring now to FIG. 7(*b*), it will be apparent that the numerals extending from each side of FIG. 7(*b*) are helpful in understanding the coil configuration upon winding. For example, a length of tube extends from the detent (1) on the lower left side of FIG. 7(*b*) to the detent (1) which lies thereabove on the right side of FIG. 7(*b*), and so on.

Mention was made earlier of external surface enhancements in the form of annular fins 102. In such embodiments, a surface enhancement that extends up to 1.0 mm from the outside tube surface tends to promote heat transfer. Other forms of surface enhancement could be provided, such as needles 102*a* that may extend up to 1.0 mm or more into the fluid (such as air) that flows outside the tubes. External surface enhancements 102, 102*a* of the type shown in FIG. 4 are well known to those having ordinary skill in the art.

In FIG. 2, the two tubes (outlets) on the left hand side terminate in opening through an internally directed heat exchange fluid emerges. FIG. 2 shows the tube inlets and outlets. It will be apparent that if desired, the inlets could be switched to outlets and vice-versa. Depending on the application, cross flow could occur. In such configurations, the direction of flow of internally directed heat exchange fluid could be in the opposite direction from that which flows in another layer of the heat exchanger.

In an alternate embodiment of the invention, the spacer member 24 in FIGS. 1, 2 5-6, 7(*a*) and 7(*b*) could also be configured with a hollow interior. If so, the member 24 could serve as a manifold that accommodates refrigerant before and after it passes through tubes with which the manifold is in communication via a passage defined through the tube wall and into the spacer/manifold member 24. In this capacity, the manifold/spacer member 24 serves as a circuiting device.

During the manufacturing steps, a spacer member 24 that is configured as a manifold may itself serve as a mandrel or holder for a tube that is wrapped therearound. In such manufacturing steps, the spacer member 24 serving as a mandrel also serves as a fixture that assists in forming a heat exchanger having a desired configuration.

Mention was made earlier that the embodiments of FIGS. 1, 2 & 5 could include one or more layers that are formed from racetrack-like turns. Other things being equal, in heat exchangers having turns (as opposed to straight runs), more of a centrifugal force is exerted upon heat exchanger fluid moving therewithin. In general, without being bound to any particular theory, the fluid tends to accelerate and separate through the bend radii. As a result, there are different mixing characteristics as compared to those that are found under comparable conditions in heat exchangers having a preponderance of continuity or linearity in the tubes.

While embodiments of the invention have been illustrated and described, it is not intended that these embodiments illustrate and describe all possible forms of the invention. Rather, the words used in the specification are words of description rather than limitation, and it is understood that various changes may be made without departing from the spirit and scope of the invention.

What is claimed is:

1. A heat exchanger that transfers thermal energy between an internal heat exchange fluid that flows within the exchanger and an external heat exchange fluid in thermal communication with the internal heat exchange fluid, the heat exchanger comprising:

one or more layers of a tube within which the internal heat exchange fluid passes;

at least some of the one or more layers having an oblong ovate configuration with opposing linear runs connected by opposing curved sections, the internal heat exchange fluid passing sequentially through successive ones of the linear runs;

a planar spacer member that extends perpendicularly in relation to the linear runs, the spacer member having forwardly and rearwardly facing edges, the forwardly and rearwardly facing edges each have detents spaced apart at a center-to-center distance, each detent has a major diameter and the detents are truncated and terminate at the forwardly and rearwardly facing edges at positions that are offset from the major diameters of the detents, and wherein the opposing linear runs are detachably retained by the detents in the forwardly and rearwardly facing edges of the planar spacer member with a snap fit such that each successive ones of the linear runs are spaced apart, in an extension direction of the planar spacer member, by a distance greater than the center-to-center distance of the detents.

2. The tube heat exchanger of claim 1, wherein the forwardly facing edges and the rearwardly facing edges detachably retain successive ones of the linear runs in an alternating sequence.

3. The tube heat exchanger of claim 1, wherein each of the detents has an open portion that is less than the major diameter of the detent in order to allow the opposing linear runs to be snap fitted to the planar spacer member.

4. The heat exchanger of claim 1, wherein the tube is circular and has an outside diameter (OD), an inside diameter (ID) and a wall thickness (T=(OD-ID)/2), wherein the ratio of (T) to (OD) is between 0.01 and 0.1.

5. The heat exchanger of claim 1 wherein the spacer member assumes a hoop-like configuration.

6. The heat exchanger of claim 1 wherein the opposed curved sections are arranged in pairs and wherein the sections in a given pair have differing radii of curvature.

7. The heat exchanger of claim 1 wherein the ratio of the average radius of opposing curved sections to the tube outside diameter (OD) is approximately 10 to 3.

8. The heat exchanger of claim 1 wherein the one or more layers of a tube have one inlet and one outlet.

9. The heat exchanger of claim 1 wherein the one or more layers of a tube have multiple inlets and outlets.

10. The heat exchanger of claim 1, wherein the tube has an average outside diameter (OD), an average inside diameter (ID), and an average wall thickness (T=(OD-ID)/2), wherein the ratio of (T) to (OD) is between 0.01 and 0.1.

11. The heat exchanger of claim 1 wherein the one or more layers are provided with a surface enhancement that extends from an outside surface of the tube.

12. The heat exchanger of claim 1 wherein the one or more layers are provided with an internal surface enhancement that extends from an inside surface of the tube.

13. The heat exchanger of claim 12 wherein the internal surface enhancement is selected from the group consisting of a helical groove, a herringbone pattern, a cross-hatched pattern, a V-configuration and a tube-spiral surface texture.

14. The heat exchanger of claim 1 wherein the direction of flow within one layer of a tube is opposite from the direction of flow in the tube of another layer, such that there is cross flow between the layers.

15. The heat exchanger of claim 1 wherein the tube has a cross sectional profile selected from the group consisting of a circle, an oval, a rectangle with rounded corners, multiport, multi-channel, and combinations thereof.

16. The heat exchanger of claim 1, further including a manifold that accommodates a heat exchanger fluid that is delivered to the one or more layers of tube.

17. The heat exchanger according to claim 1 wherein the opposing linear runs includes tubes that are round and each of the detents has a frusto-circular shape.

18. The heat exchanger according to claim 1 wherein the planar spacer member is deformable in order that the opposing linear runs are capable of being snap fitted into the detents.

19. The heat exchanger according to claim 1, wherein said distance, in the extension direction of the planar spacer member, between successive ones of the linear runs is more than two times the center-to-center distance.

20. The heat exchanger according to claim 19, wherein the distance, in the extension direction of the planar spacer member, between successive ones of the linear runs is more than three times the center-to-center distance.

21. The heat exchanger according to claim 1, wherein the tube is circular and has an outside diameter, wherein the center-to-center distance of the detents is twice the outside diameter.

22. A heat exchanger that transfers thermal energy between an internal heat exchange fluid that flows within the exchanger and an external heat exchange fluid in thermal communication with the internal heat exchange fluid, the heat exchanger comprising:

one or more layers of a tube within which the internal heat exchange fluid passes, each layer including opposing linear runs connected by opposing curved sections, the internal heat exchange fluid passing sequentially through successive ones of the linear runs;

at least some of the one or more layers having a uniform bend radius; and a planar spacer member that extends perpendicularly in relation to the one or more layers, the spacer member having forwardly and rearwardly facing edges, the forwardly and rearwardly facing edges each have engagement surfaces defining a center location in which a respective portion of the tube is received, wherein adjacent center locations are spaced apart a first distance and each of the one or more layers is detachably retained by the planar spacer member with a snap fit to the engagement surfaces of the forwardly and rearwardly facing edges, such that each successive ones of the linear runs are spaced apart, in an extension direction of the planar spacer member, by a second distance greater than the first distance between the adjacent center locations.

* * * * *